US008090301B2

(12) United States Patent
Suzuki

(10) Patent No.: US 8,090,301 B2
(45) Date of Patent: Jan. 3, 2012

(54) IMAGE FORMING APPARATUS

(75) Inventor: Masayuki Suzuki, Tokyo (JP)

(73) Assignee: Oki Data Corporation, Tokyo (JP)

( * ) Notice: Subject to any disclaimer, the term of this patent is extended or adjusted under 35 U.S.C. 154(b) by 177 days.

(21) Appl. No.: 12/382,900

(22) Filed: Mar. 26, 2009

(65) Prior Publication Data

US 2009/0324261 A1 Dec. 31, 2009

(30) Foreign Application Priority Data

Jun. 30, 2008 (JP) ..... 2008-171422

(51) Int. Cl.
*G03G 15/08* (2006.01)

(52) U.S. Cl. ..... 399/258

(58) Field of Classification Search ..... 399/260, 399/258, 25

See application file for complete search history.

(56) References Cited

U.S. PATENT DOCUMENTS

| | | | | |
|---|---|---|---|---|
| 2005/0117919 | A1* | 6/2005 | Ito et al. | 399/27 |
| 2005/0196184 | A1* | 9/2005 | Koyama et al. | 399/27 |
| 2006/0216046 | A1* | 9/2006 | Hatakeyama | 399/27 |
| 2008/0285986 | A1* | 11/2008 | Wada et al. | 399/27 |

FOREIGN PATENT DOCUMENTS

| | | |
|---|---|---|
| JP | 04-346377 | 12/1992 |
| JP | 09-281770 | 10/1997 |
| JP | 2006-267528 | 10/2006 |

* cited by examiner

*Primary Examiner* — Constantine Hannaher
(74) *Attorney, Agent, or Firm* — Kubotera & Associates, LLC

(57) ABSTRACT

An image forming apparatus is provided with an image forming portion for forming an image according to image information; an image forming unit arranged to be detachable and integrally including the image forming portion; a developer container arranged to be detachable for supplying developer to the image forming portion; and a blocking member for blocking developer from being supplied from the developer container to the image forming portion.

16 Claims, 6 Drawing Sheets

IMAGE FORMING APPARATUS

BACKGROUND OF THE INVENTION AND RELATED ART STATEMENT

The present invention relates to an image forming apparatus having an image forming unit for printing image data input from a host device on a recording medium, in which developer is supplied to the image forming unit according to a specific control sequence.

In a conventional image forming apparatus such as a printer, a copier, a facsimile, and the likes, supply components such as an image supporting member, a charging unit, a developer supporting member, a developer supply unit, and a cleaning unit are disposed in an image forming unit. A developer container for supplying developer is detachably attached to the image forming unit.

In an integrated image forming unit, in which a plurality of image forming units in several colors is disposed in an integrated frame, a plurality of developer containers in several colors is independently and detachably attached to the integrated image forming unit. Only a developer container retaining a small amount of developer is replaced. The image forming units generally have a lifetime longer than that of the developer containers. Accordingly, the developer container is replaced several times during the lifetime of the image forming unit (refer to Patent Reference).

Patent Reference: Japanese Patent Publication No. 09-281770

In the conventional integrated image forming unit described above, when the image forming unit is replaced, if the developer container still retains a large amount of developer, it is necessary to discard a large amount of developer. Further, when the image forming unit is replaced while the developer container still retains a large amount of developer, developer may spill.

In view of the problems described above, an object of the present invention is to provide a medium transportation apparatus and an image reading apparatus, in which an amount of developer is controlled when an image forming unit is replaced. Accordingly, it is possible to reduce an amount of developer to be discarded when the image forming unit is replaced.

Further objects and advantages of the invention will be apparent from the following description of the invention.

SUMMARY OF THE INVENTION

In order to attain the objects described above, according to an aspect of the present invention, an image forming apparatus is provided with an image forming portion for forming an image according to image information; an image forming unit arranged to be detachable and integrally including the image forming portion; a developer container arranged to be detachable for supplying developer to the image forming portion; and a blocking member for blocking developer from being supplied from the developer container to the image forming portion.

In the aspect of the present invention, when the image forming unit is replaced, it is controlled to sufficiently reduce an amount of developer retained in the image forming portion. Accordingly, when the image forming unit is replaced, it is possible to reduce an amount of developer retained in the image forming portion to be discarded.

DETAILED DESCRIPTION OF THE PREFERRED EMBODIMENTS

Hereunder, embodiments of the present invention will be explained with reference to the accompanying drawings. According to the present invention, an image forming apparatus is not limited to the embodiments explained below, and may be modified within scope of the present invention.

First Embodiment

A first embodiment of the present invention will be explained. In the first embodiment, an image forming apparatus is provided with an image forming portion; an image forming unit retaining the image forming portion and arranged to be detachable; a developer container arranged to be detachable for supplying developer to the image forming portion; and a blocking member for blocking developer from being supplied from the developer container to the image forming portion.

Figure 1:
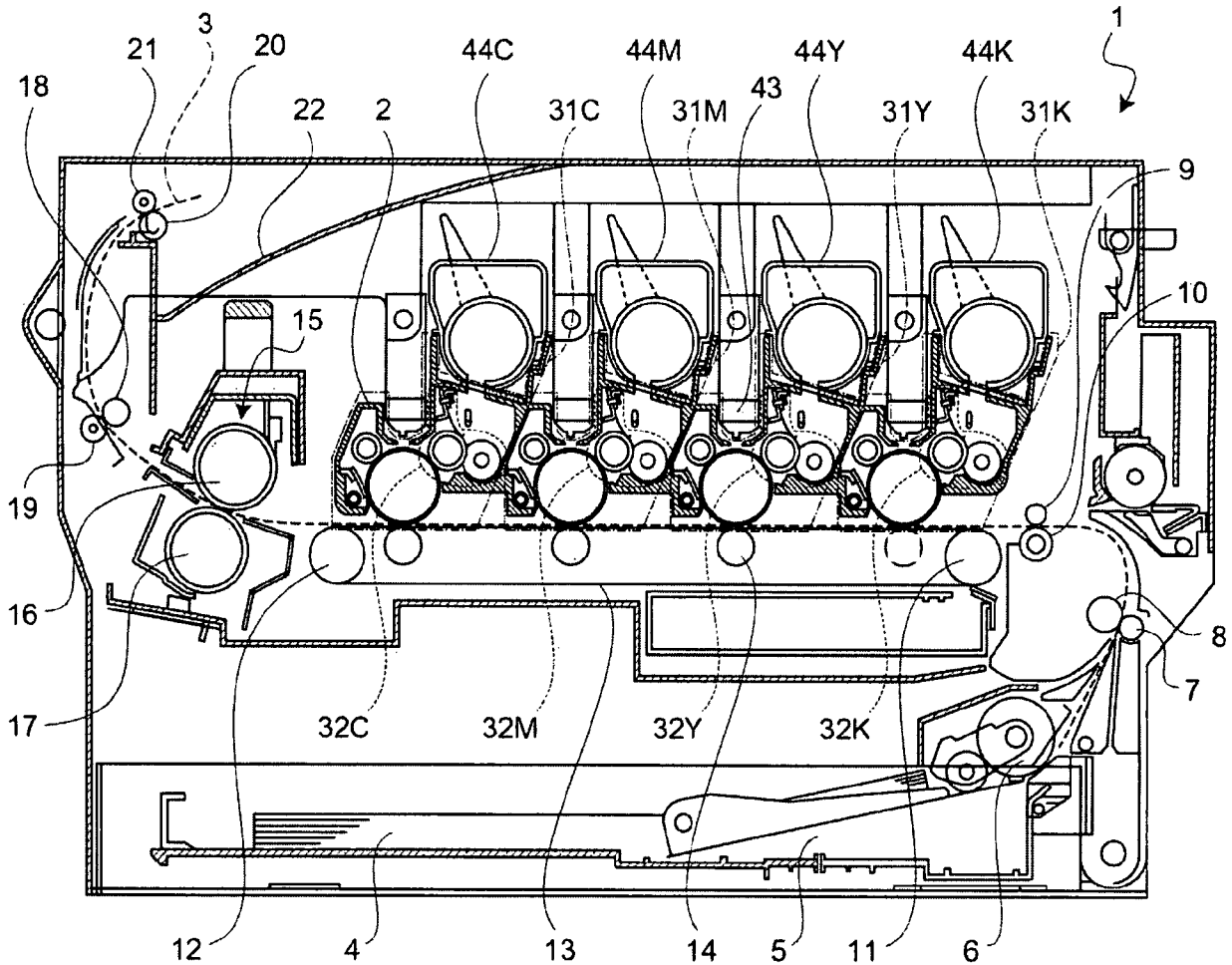
FIG. 1 is a schematic sectional view showing an image forming apparatus according to a first embodiment of the present invention.

FIG. 1 is a schematic sectional view showing an image forming apparatus 1 according to the first embodiment of the present invention. As shown in FIG. 1, the image forming apparatus 1 includes a sheet transportation path 3 having a substantially S character shape and extending from a sheet supply cassette 5 for retaining a recording medium 4 as a starting point to a stacker 22 for discharging the recording medium 4 as an ending point; a process cartridge 2 integrally including a plurality of image forming portions 31 for printing on the recording medium 4 according to image information; exposure devices 43 for irradiating photosensitive drums 41 (described later) according to the image information; and toner cartridges 44 as a developer container for supplying toner as developer to the process cartridge 2.

In the image forming apparatus 1, the sheet transportation path 3 extends from the sheet supply cassette 5 for retaining the recording medium 4 as the starting point to the stacker 22 for discharging the recording medium 4 as the ending point through a hopping roller 6, a pressure roller 7, a register roller 8, a pressure roller 9, a register roller 10, an idle roller 11, a drive roller 12, a transfer belt 13, transfer rollers 14, a fixing unit 15, a transport roller 18, a transport roller 19, a discharge roller 20, and a discharge roller 21.

In the following description, the components of the sheet transportation path 3 will be explained in more detail with reference to FIG. 1. The recording medium 4 is a recording sheet with a specific size on which image information in color or monochrome is printed. In general, the recording medium 4 includes a paper sheet such as a recycle sheet, a gloss sheet, or a high quality sheet, or an OHP film.

In the embodiment, the sheet supply cassette 5 retains the recording medium 4, so that the recording medium 4 is supplied to the image forming apparatus 1 when a printing operation starts. It is arranged such that the sheet supply cassette 5 is detachable relative to the image forming apparatus 1. The hopping roller 6 is arranged to abut against the recording medium 4 retained in the sheet supply cassette 5. When the hopping roller 6 rotates, the hopping roller 6 picks up the recording medium 4 from the sheet supply cassette 5 one by one, and transports the recording medium 4 to the pressure roller 7 and the register roller 8.

In the embodiment, the pressure roller 7 and the register roller 8 are arranged to sandwich the recording medium 4 thus transported. More specifically, the register roller 8 is pressed against the pressure roller 7 to rotate, so that the recording medium 4 is transported to the pressure roller 9 and the register roller 10 while removing skew of the recording medium 4. The pressure roller 9 and the register roller 10 are arranged to sandwich the recording medium 4. More specifically, the register roller 10 is pressed against the pressure roller 9 to rotate, so that the recording medium 4 is attached to the transfer belt 13 while removing skew of the recording medium 4.

In the embodiment, the idle roller 11 and the drive roller 12 are disposed at both end portions of the transfer belt 13 formed of an endless belt, thereby applying a specific tension to the transfer belt 13. The idle roller 11 and the drive roller 12 are formed of a material with high friction resistance. When a drive source (not shown) rotates the idle roller 11 and the drive roller 12, the transfer belt 13 is followed and driven.

In the embodiment, the transfer belt 13 functions as a transport member for transporting the recording medium 4 to the image forming portions 31 and transferring the image information to the recording medium 4. The transfer belt 13 is formed of an endless belt, so that the recording medium 4 is attached to a circumferential surface thereof. The transfer rollers 14 are disposed below the photosensitive drums 41, and are arranged to be rotatable in a state that the transfer rollers 14 and the photosensitive drums 41 sandwich the recording medium 4. A bias voltage having a polarity opposite to charges of toner is applied to the transfer rollers 14, thereby transferring toner images formed on surfaces of the photosensitive drums 41 to the recording medium 4.

In the embodiment, the fixing unit 15 is formed of a fixing roller 16 and a pressing roller 17. The fixing roller 16 and the pressing roller 17 are arranged to face each other and sandwich the recording medium 4 transported with the transfer belt 13, so that the toner images formed on the recording medium 4 with the image forming portions 31 are fixed to the recording medium 4. More specifically, a halogen lamp is disposed in the fixing roller 16 for melting the toner images formed on the recording medium 4, and the pressing roller 17 presses the recording medium 4 to fix the toner images to the recording medium 4. Note that the pressing roller 17 follows a rotation of the fixing roller 16 to rotate.

In the embodiment, the transport roller 18 and the transport roller 19 are arranged to face with each other and sandwich the recording medium 4 transported from the fixing unit 15. The transport roller 19 follows a rotation of the transport roller 18 to rotate for transporting the recording medium 4 to the discharge roller 20 and the discharge roller 21. The transport roller 20 and the discharge roller 21 are arranged to face with each other and sandwich the recording medium 4 transported from the transport roller 18 and the transport roller 19. The transport roller 21 follows a rotation of the discharge roller 20 to rotate for transporting the recording medium 4 to the stacker 22. The stacker 22 is provided as a storage space for placing and retaining the recording medium 4 with the image information developed thereon after the recording medium 4 is discharged.

Figure 2:
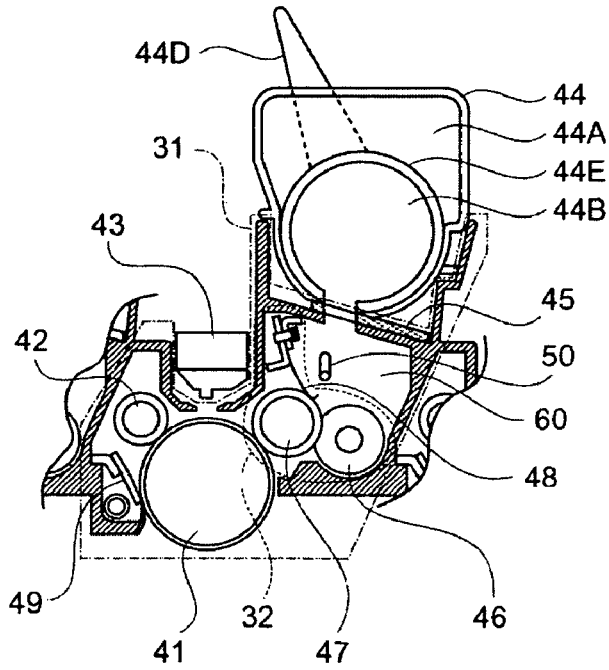
FIG. 2 is a schematic sectional view showing an image forming portion, an exposure device, and a toner cartridge disposed in the image forming apparatus according to the first embodiment of the present invention.

Next, the image forming portions 31, the exposure devices 43, and the toner cartridges 44 disposed in the image forming apparatus 1 will be explained in more detail with reference to FIG. 2. FIG. 2 is a schematic sectional view showing the image forming portion 31, the exposure device 43, and the toner cartridge 44 disposed in the image forming apparatus 1 according to the first embodiment of the present invention.

In the embodiment, the image forming portion 31 includes the photosensitive drum 41 for supporting a static latent image according to the image information; a charging device 42 for uniformly charging the surface of the photosensitive drum 41; a developing device 32 for supplying toner in a specific amount to the surface of the photosensitive drum 41; a cleaning blade 49 for scraping off toner remaining on the photosensitive drum 41; a toner shutter 45 for controlling an amount of toner supplied from the toner cartridge 44 to the image forming portion 31; and a toner remaining amount detection unit 50 for detecting a remaining amount of toner in a toner storage portion 60.

In the embodiment, the exposure device 43 is disposed in the image forming apparatus 1 above the photosensitive drum 41 in the image forming portion 31 for irradiating the surface of the photosensitive drum 41 according to the image information. The toner cartridge 44 for retaining toner is disposed above the image forming portion 31.

The components described above will be explained in more detail next. The image forming portions 31 include image forming portions 31C, 31M, 31Y, and 31K corresponding to colors of cyan, magenta, yellow, and black. The image forming portions 31C, 31M, 31Y, and 31K have an identical configuration, and are collectively referred to as the image forming portions 31. The photosensitive drum 41 is an image supporting member for forming a developer image thereon, and is configured to be capable of accumulating electron charges on a surface thereof for supporting a static latent image. The photosensitive drum 41 is formed of a cylindrical body arranged to be rotatable. Further, the photosensitive drum 41 is formed of a conductive base layer of aluminum and the likes and a photosensitive layer formed on the conductive base layer. The photosensitive layer is formed of an optical conductive layer and an electron charge transport layer.

In the embodiment, the charging device 42 applies a specific positive or negative voltage to the surface of the photosensitive drum 41 with a power source (not shown), so that electron charges are uniformly accumulated on the surface of the photosensitive drum 41. The charging device 42 is arranged to be rotatable while contacting with the surface of the photosensitive drum 41. The charging device 42 is formed of a conductive metal shaft covered with a semi-conductive rubber such as a silicone rubber.

In the embodiment, the exposure device 43 is disposed above the photosensitive drum 41 for irradiating the surface of the photosensitive drum 41 according to the image information for forming the static latent image on the surface of the photosensitive drum 41. The exposure device 43 is formed of a plurality of LED elements, a lens array, and an LED drive element.

In the embodiment, the toner cartridge 44 is a developer container for retaining toner as developer, and is disposed above the image forming portion 31. The toner cartridges 44 include toner cartridges 44C, 44M, 44Y, and 44K corresponding to colors of cyan, magenta, yellow, and black. The toner cartridges 44C, 44M, 44Y, and 44K have an identical configuration, and are collectively referred to as the toner cartridges 44.

As shown in FIG. 2, the toner cartridge 44 includes a toner storage section 44A having a side surface with a substantially rectangular shape, and is formed in a rectangular shape extending in a direction perpendicular to a direction that the recording medium 4 is transported. The toner cartridge 44 further includes a toner stirring section 44B arranged below the toner storage section 44A. The toner stirring section 44B has a side surface with a substantially circular shape, and is formed in a cylindrical shape extending in a direction perpendicular to the direction that the recording medium 4 is transported. The toner stirring section 44B is connected to the toner storage section 44A with an opening portion therebetween, so that the toner storage section 44A and the toner stirring section 44B constitute one section.

In the embodiment, a toner cartridge fixing toner supply lever 44D is connected to one end portion of a toner opening/closing shutter 44E arranged as an outer wall portion of the toner stirring section 44B. The toner cartridge fixing toner supply lever 44D is formed of a hard material in a substantially bow shape.

When the toner cartridge fixing toner supply lever 44D rotates in a specific direction, the toner cartridge 44 is fixed to the image forming portion 31, and a toner supply opening portion (not shown) opens in a state that a lower portion of the toner cartridge 44 is situated above an upper portion of the image forming portion 31. In this state, when a toner stirring bar (not shown) disposed in the toner stirring section 44B rotates at a specific rotational rate, toner retained in the toner cartridge 44 is supplied to the image forming portion 31. Note that the toner cartridge 44 is configured to be detachable relative to the image forming portion 31, so that the toner cartridge 44 is replaced when toner is run but through the printing operation. The toner shutter 45 is disposed at an upper portion of the image forming portion 31 for controlling toner supplied from the toner cartridge 44 to the image forming portions 31. The toner shutter 44 will be explained later in more detail with reference to FIG. 3.

In the embodiment, the developing device 32 is provided for supplying toner in a specific amount to the surface of the photosensitive drum 41. The developing device 32 includes a toner supply roller 46, a developing roller 47, and a developing blade 48. The developing devices 32 include developing devices 32C, 32M, 32Y, and 32K corresponding to colors of cyan, magenta, yellow, and black. The developing devices 32C, 32M, 32Y, and 32K have an identical configuration, and are collectively referred to as the developing devices 32.

In the embodiment, the toner supply roller 46 is arranged to abut against the developing roller 47 while rotating for supplying toner to the developing roller 47. The toner supply roller 46 is formed of a metal shaft with conductivity coated with a rubber containing a foaming agent. The developing roller 47 is arranged to be rotatable while contacting with the surface of the photosensitive drum 41 with a specific pressure. The developing roller 47 transports toner to the photosensitive drum 41 while rotating, so that the static latent image formed on the surface of the photosensitive drum 41 is developed with toner. The developing roller 47 includes a hollow cylindrical member, and is formed of a metal shaft with conductivity coated with a semi-conductive urethane rubber. The developing blade 48 is arranged to abut against a surface of the developing roller 47 at a distal end portion thereof. The developing blade 48 scrapes off toner beyond a specific amount supplied from the toner supply roller 46 to the surface of the developing roller 47, so that a thickness of toner formed on the surface of the developing roller 47 is maintained at a constant level all the time. The developing blade 48 is formed of an elastic plate member such as a stainless steel plate.

In the embodiment, the cleaning blade 49 is configured to scrape off toner remaining on the photosensitive drum 41 after the toner image formed on the photosensitive drum 41 is transferred to the recording medium 4. The cleaning blade 49 is formed of a plate member, and is disposed on an upstream side of the stacker 22 in a rotational direction of the photosensitive drum 41 to abut against the surface of the photosensitive drum 41 with a constant pressure. The cleaning blade 49 may be formed of a roller member such as a fur brush.

In the embodiment, the toner remaining amount detection unit 50 is disposed above the toner supply roller 46 of the toner storage portion 60 inside the image forming portion 31 as a toner stirring shaft member for stirring toner inside the toner storage portion 60 and detecting a remaining amount of toner inside the toner storage portion 60. It is determined when the toner shutter 45 is opened upon replacing the process cartridge 2 according to the remaining amount of toner inside the toner storage portion 60 detected with the toner remaining amount detection unit 50 (described later).

A configuration of the toner remaining amount detection unit 50 will be explained in more detail next. When the toner remaining amount detection unit 50 rotates around one end portion thereof, i.e., a rotational shaft thereof, a stirring portion formed at the other end portion of the toner remaining amount detection unit 50 stirs toner inside the toner storage portion 60. A rotational gear (not shown) is disposed around an outer circumference of the rotational shaft of the toner remaining amount detection unit 50, so that the rotational gear engages a protruding portion disposed near the rotational shaft of the toner remaining amount detection unit 50.

In the state described above, when the rotational gear rotates in a specific direction at a specific speed, the rotational gear drives the toner remaining amount detection unit 50 to rotate. Further, a reflection mirror is attached to the toner remaining amount detection unit 50. An optical detection device (not shown) emits light from a light emitting portion thereof. It is arranged such that the reflection mirror reflects light emitted from the optical detection device, so that a light receiving portion of the optical detection device receives light. Note that only when the toner remaining amount detection unit 50 is situated within a specific rotational range, the light receiving portion of the optical detection device receives light reflected from the reflection mirror.

An operation of the toner remaining amount detection unit 50 will be explained next in two cases, i.e., that the remaining amount of toner inside the toner storage portion 60 is large, and that the remaining amount of toner inside the toner storage portion 60 is small. The operation of the toner remaining amount detection unit 50 in the case that the remaining amount of toner inside the toner storage portion 60 is small will be explained first.

As described above, when the rotational gear rotates in a specific direction at a specific speed, the rotational gear drives the toner remaining amount detection unit 50 disposed in the toner storage portion 60 to rotate around the rotational shaft thereof. When the rotational gear drives the toner remaining amount detection unit 50, and the stirring portion of the toner remaining amount detection unit 50 rotates beyond an angle corresponding to one o'clock, the protruding portion disposed near the rotational shaft of the toner remaining amount detection unit 50 is disengaged from the rotational gear.

Accordingly, the toner remaining amount detection unit 50 freefalls to a position of toner while rotating.

In the embodiment, it is configured such that only when the toner remaining amount detection unit 50 freefalls to a position of toner while rotating, the light receiving portion of the optical detection device receives light emitted from the optical detection device and reflected from the reflection mirror disposed on the toner remaining amount detection unit 50. Accordingly, when the remaining amount of toner inside the toner storage portion 60 is small, the toner remaining amount detection unit 50 freefalls to a position of toner while rotating over a long distance, thereby increasing a period of time during which the optical detection device receives light reflected from the reflection mirror.

On the other hand, when the remaining amount of toner inside the toner storage portion 60 is large, the toner remaining amount detection unit 50 freefalls to a position of toner while rotating over a short distance, thereby decreasing a period of time during which the optical detection device receives light reflected from the reflection mirror. Accordingly, it is possible to detect the remaining amount of toner inside the toner storage portion 60 according to a period of time during which the optical detection device receives light reflected from the reflection mirror.

Figure 3:
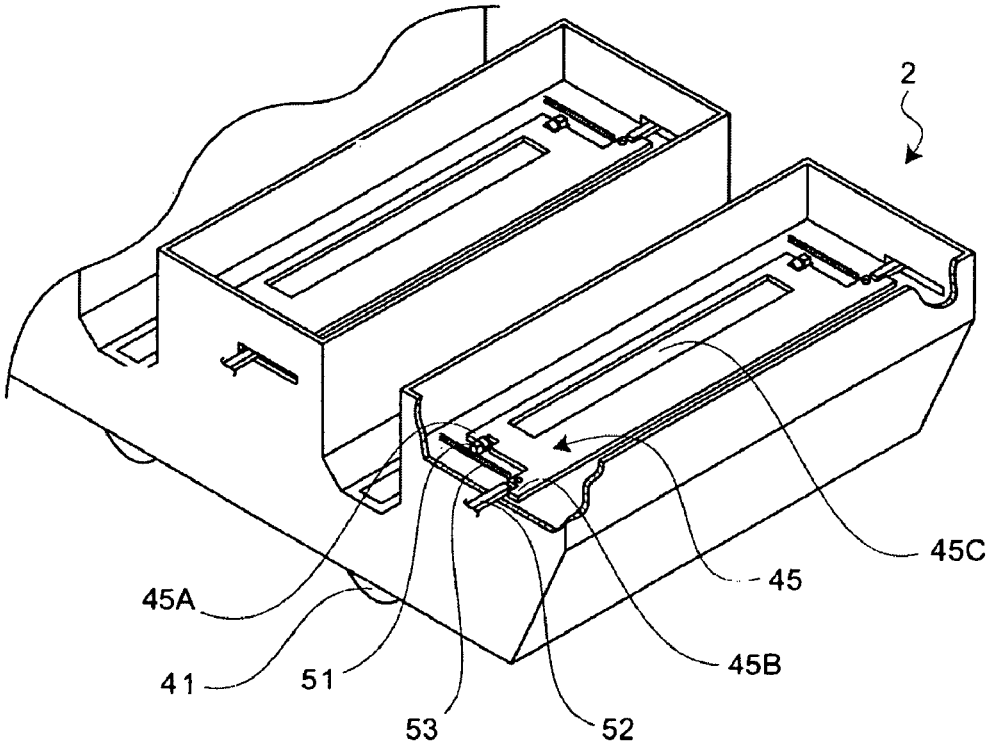
FIG. 3 is a schematic perspective view showing a process cartridge of the image forming apparatus according to the first embodiment of the present invention.

The toner shutter 45 disposed in the image forming portions 31 of the image forming apparatus 1 will be explained in more detail next. The toner shutter 45 blocks toner supplied from the toner cartridges 44 to the image forming portions 31 according to a control sequence (described later). FIG. 3 is a schematic perspective view showing the process cartridge 2 of the image forming apparatus 1 according to the first embodiment of the present invention, in which the toner shutters 45 block toner supplied from the toner cartridges 44 to the image forming portions 31.

Regarding the operation of the toner shutter 45 blocking toner supplied from the toner cartridges 44 to the image forming portions 31, in addition to the components shown in FIGS. 1 and 2, the process cartridge 2 includes the toner shutters 45 for controlling supply of toner; toner cartridge connection hooks 51 for disengaging the toner shutters 45 when the toner cartridges 44 are attached to the image forming portions 31; toner shutter opening/closing operation bars 52 for opening and closing the toner shutters 45; and toner shutter opening/closing springs 53 for urging the toner shutters 45 in a closing direction. With the components described above, the toner shutters 45 block toner supplied from the toner cartridges 44 to the image forming portions 31 according to the control sequence (described later).

In the embodiment, the toner shutters 45 as a blocking member are disposed at an upper portion of the image forming portions 31 for blocking toner supplied from the toner cartridges 44 to the image forming portions 31 according to a specific control sequence. As shown in FIG. 3, each of the toner shutters 45 is formed of a plate member formed of a hard material. The plate member constituting the toner shutter 45 includes connection hook engaging portions 45A; opening/closing operation bar engaging portions 45B; and a toner supply opening portion 45C.

The connection hook engaging portions 45A are formed in the plate member at both end portions thereof as recess portions for engaging the toner cartridge connection hooks 51. Similarly, the opening/closing operation bar engaging portions 45B are formed in the plate member at both end portions thereof as recess portions for engaging the toner shutter opening/closing operation bars 52. The toner supply opening portion 45C is formed in the plate member as a rectangular opening portion for supplying toner from the toner cartridge 44 to the image forming portion 31. When the toner shutter 45 is operated, the toner cartridge connection hooks 51 are disengaged and the toner shutter opening/closing operation bars 52 are operated.

In the embodiment, the toner cartridge connection hooks 51 are disposed at the upper portion of the image forming portion 31 at two locations for engaging the connection hook engaging portions 45A formed in the plate member of the toner shutter 45 at both end portions thereof, respectively. Further, the toner cartridge connection hooks 51 are formed of claw members formed of a hard material for disengaging the toner shutter 45 when the toner cartridge 44 is attached to the image forming portion 31.

When a specific load is applied to the toner cartridge connection hooks 51 from above, the toner cartridge connection hooks 51 are retracted into the image forming portion 31. When the specific load is released, the toner cartridge connection hooks 51 protrude from the image forming portion 31. More specifically, when the toner cartridge 44 is attached to the image forming portion 31, protruding portions (not shown) disposed at a lower portion of the toner cartridge 44 abut against the toner cartridge connection hooks 51, so that the toner shutter 45 is disengaged. When the toner cartridge 44 is detached from the image forming portion 31, the toner cartridge connection hooks 51 protrude from the image forming portions 31, thereby fixing the toner shutter 45 again.

In the embodiment, the toner shutter opening/closing operation bars 52 are disposed at both side portions of the image forming portion 31 for engaging the opening/closing operation bar engaging portions 45B formed in the plate member of the toner shutter 45 at both end portions thereof, respectively. The toner shutter opening/closing operation bars 52 are formed of lever members having a rod shape and formed of a hard material. A drive member drives the toner shutter opening/closing operation bars 52 for opening and closing the toner shutter 45 according to the control sequence described later with reference to FIGS. 4 and 5. Note that when the toner cartridge 44 is detached and released from the image forming portion 31, the toner shutter opening/closing operation bars 52 are not operable.

In the embodiment, the toner shutter opening/closing springs 53 are spring members disposed at both side portions of the image forming portion 31. One end portion of each of the toner shutter opening/closing springs 53 is connected to the image forming portion 31, and the other end portion of each of the toner shutter opening/closing springs 53 is connected to the toner shutter 45 near each of the opening/closing operation bar engaging portions 45B formed in the plate member of the toner shutter 45 at both end portions thereof. The toner shutter opening/closing springs 53 are provided for urging the toner shutter 45 in the closing direction.

Figure 4:
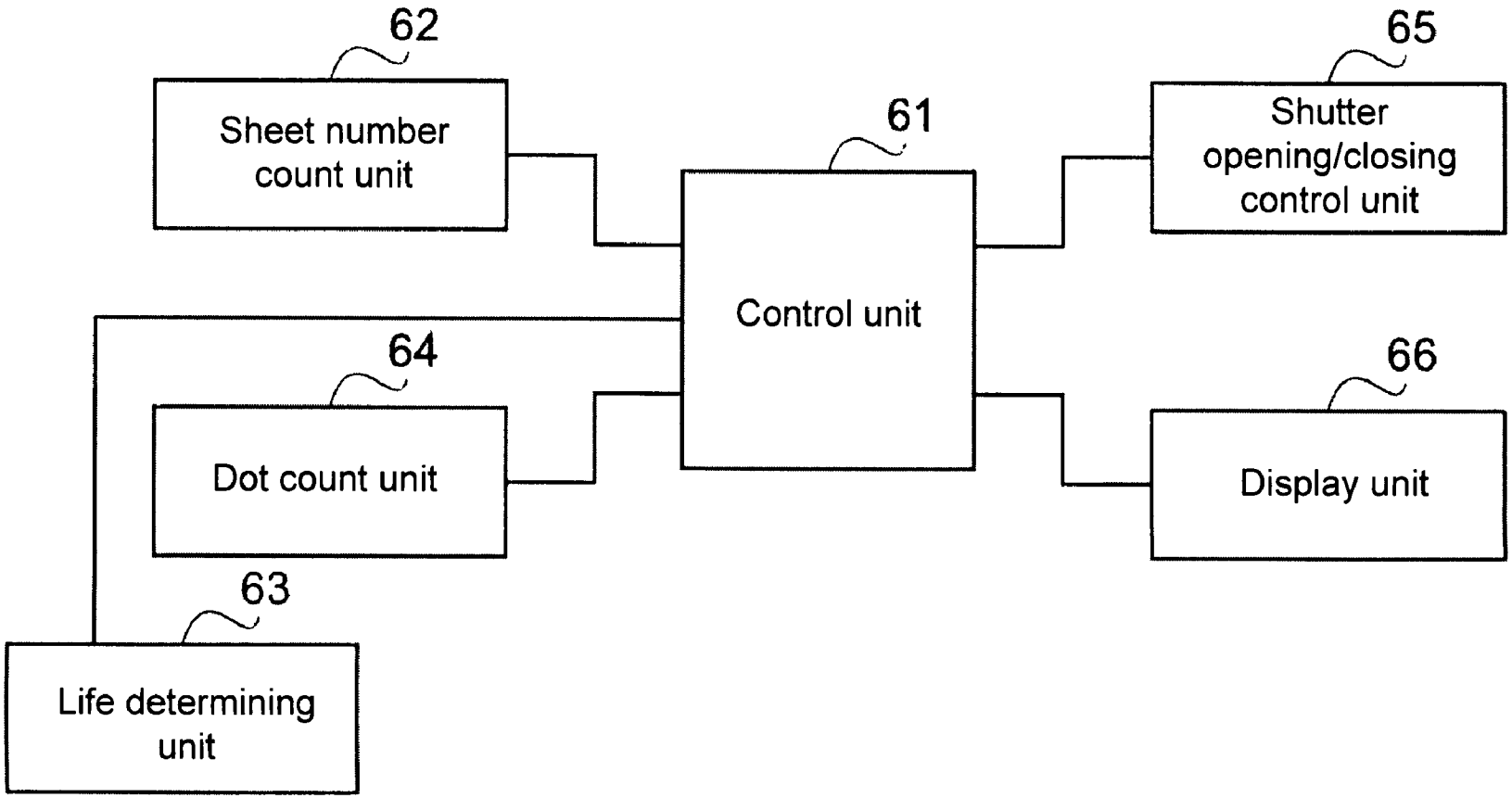
FIG. 4 is a block diagram showing a control system of the image forming apparatus according to the first embodiment of the present invention.

The control sequence associated with the replacement of the process cartridge 2 in the image forming apparatus 1 will be explained next. When the process cartridge 2 is replaced, it is controlled such that the remaining amount of toner retained in the toner storage portion 60 of the image forming portions 31 becomes a minimum level. FIG. 4 is a block diagram showing a control system of the image forming apparatus 1 according to the first embodiment of the present invention.

As shown in FIG. 4, the image forming apparatus 1 includes a control unit 61 as a control device formed of a CPU, an ROM, an RAM, an input/output port, a timer, and the likes. The control unit 61 sends an instruction to control a series of processes for developing image data on the recording medium 4 according to the image information received from a host device. Further, the control unit 61 is connected to a sheet number count unit 62; a life determining unit 63; a dot count unit 64; a shutter opening/closing control unit 65; and a display unit 66. When the process cartridge 2 is replaced, the control unit 61 controls the units described above such that the remaining amount of toner retained in the toner storage portion 60 of the image forming portions 31 becomes a minimum level.

The components of the control system will be explained in more detail with reference to FIG. 4. When the process cartridge 2 is attached to the image forming apparatus 1, according the instruction from the control unit 61, the sheet number count unit 62 measures the number of printed sheets of the image forming portions 31 from when the process cartridge 2 is attached to the image forming apparatus 1. Note that the sheet number count unit 62 may measure an accumulated rotational number of the photosensitive drums 41 in the image forming portions 31. According to the instruction from the control unit 61, the life determining unit 63 determines a replacement life of the process cartridge 2 from the number of the printed sheets of the image forming portions 31.

In the embodiment, according to the instruction from the control unit 61, the dot count unit 64 measures the number of printed dots of the image forming portions 31 from when the process cartridge 2 is attached to the image forming apparatus 1. According to the instruction from the control unit 61, the shutter opening/closing control unit 65 controls opening/closing of the toner shutters 45 of the image forming portions 31 disposed in the process cartridge 2. The display unit 66 is a display device for displaying a replacement timing of the process cartridge 2 or the toner cartridges 44 according to the instruction from the control unit 61.

Figure 5:
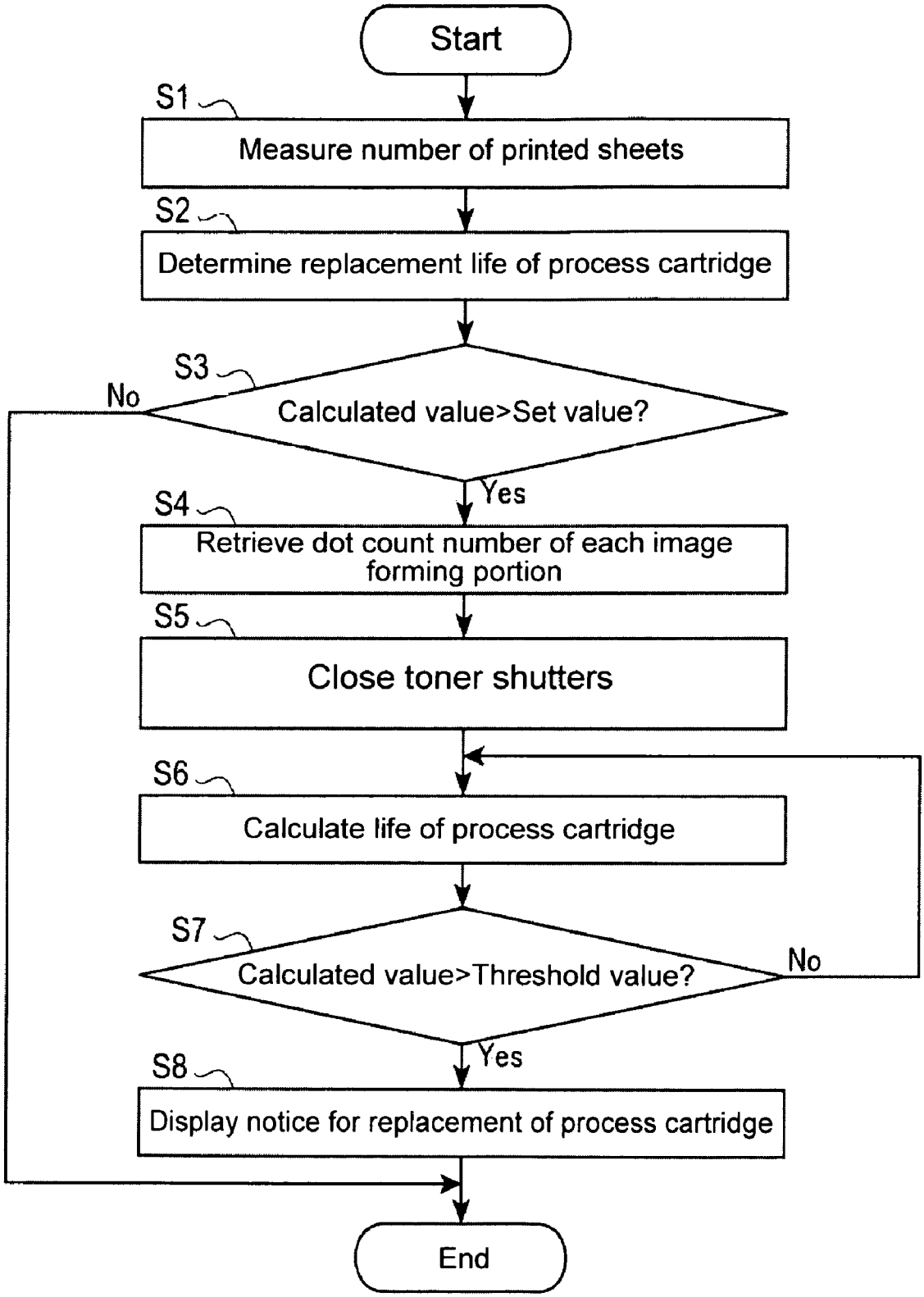
FIG. 5 is a flow chart showing an operation of the image forming apparatus according to the first embodiment of the present invention.

An operation of replacing the process cartridge 2 in the image forming apparatus 1 will be explained next. FIG. 5 is a flow chart showing an operation of the image forming apparatus 1 according to the first embodiment of the present invention. When the process cartridge 2 is replaced, it is controlled such that the remaining amount of toner retained in the toner storage portion 60 of the image forming portion 31 becomes a minimum level through the flow chart shown in FIG. 5.

In step S1, when the number of the printed sheets measured with the sheet number count unit 62 according to the instruction from the control unit 61 exceeds a specific number, a replacement display determining sequence starts, so that it is determined whether information regarding the replacement of the process cartridge 2 is displayed on the display unit 66 of the image forming apparatus 1. In the embodiment, the specific number is determined in advance according to a usage environment of the image forming apparatus 1 and the likes.

In step S2, according to the instruction from the control unit 61, the life determining unit 63 determines the replacement life of the process cartridge 2 from the number of the printed sheets of each of the image forming portions 31. In the embodiment, it is assumed that an actual life of the process cartridge 2 is defined as a life in which the process cartridge 2 is physically not capable for usage, and a theoretical life is determined through a calculation in which it is possible to maintain good image quality. A life described later corresponds to the theoretical life. For example, when the actual life is 60,000 pages, and the theoretical life corresponds to 90% of the actual life, the theoretical life becomes 54,000 pages.

In step S3, a calculated value of the replacement life determined in step S2 is compared with a set value. When the calculated value exceeds the set value, the process proceeds to step S4. When the calculated value exceeds the set value, the replacement display determining sequence is completed. The set value is determined in advance according to the use environment of the image forming apparatus 1 and the likes. In step S4, according to the instruction from the control unit 61, a dot count number of each of the image forming portions 31 from when the process cartridge 2 is attached to the image forming apparatus 1 is retrieved.

In one of the image forming portions 31 having a small dot count number, the image data printed on the recording medium 4 is small and a consumption rate of toner is slow. Accordingly, after the toner shutter 45 is closed to stop supplying toner from the toner cartridge 44 to the image forming portion 31, it is possible to print on a large number of recording media 4 until an amount of toner retained in the toner storage portion 60 is sufficiently reduced. On the other hand, in another of the image forming portions 31 having a large dot count number, the image data printed on the recording medium 4 is large and the consumption rate of toner is fast. Accordingly, after the toner shutter 45 is closed to stop supplying toner from the toner cartridges 44 to the image forming portions 31, it is possible to print on only a small number of recording media 4 until an amount of toner retained in the toner storage portion 60 is sufficiently reduced. In step S5, the toner shutters 45 disposed in the image forming portions 31 are closed according to the dot count number in an order starting from the one of the image forming portions 31 having the small dot count number.

In step S6, according to the instruction from the control unit 61, the life of the process cartridge 2 is calculated from the number of the printed sheets measured with the sheet number count unit 62. In step S7, a calculated value of the life of the process cartridge 2 calculated in step S6 is compared with a threshold value determined in advance. When the calculated value exceeds the threshold value, the process proceeds to step S8. When the calculated value is less than the threshold value, the process returns to step S6 after a specific period of time. In the embodiment, the threshold value is determined in advance according to the use environment of the image forming apparatus 1 and the likes. In step S8, according to the instruction from the control unit 61, a notice is displayed on the display unit 66 for prompting the replacement of the process cartridge 2, thereby completing the replacement display determining sequence.

As described above, in the embodiment, it is controlled such that the toner shutter 45 disposed in the image forming portion 31 is closed according to the dot count number in the order starting from the image forming portion 31 having the small dot count number. With the control sequence described above, when the process cartridge 2 is replaced, the amount of toner retained in the toner storage portions 60 disposed all the image forming portions 31 is sufficiently reduced. Accordingly, when the process cartridge 2 is replaced, it is possible to reduce the amount of toner remaining in the toner storage portions 60 of the image forming portions 31 to be discarded.

Further, it is possible to attach the toner cartridges 44 removed when the process cartridge 2 is replaced to the process cartridge 2 after the replacement. It is configured that when the toner cartridges 44 are detached from the image forming portions 31, and the toner shutters 45 are fixed, the toner shutter opening/closing operation bars 52 are not operable. Accordingly, it is possible to prevent toner from scattering from the image forming portions 31 when the process cartridge 2 is replaced.

Second Embodiment

A second embodiment of the present invention will be explained next. In the second embodiment, the image forming apparatus 1 further includes a dot count unit 72 for measuring a print dot number after the toner cartridges 44 are replaced. Accordingly, the shutter opening/closing control unit 65 blocks toner from being supplied the toner cartridges 44 in an order starting from one of the image forming portions 31 having a small print dot number before the life of the process cartridge 2.

Figure 6:
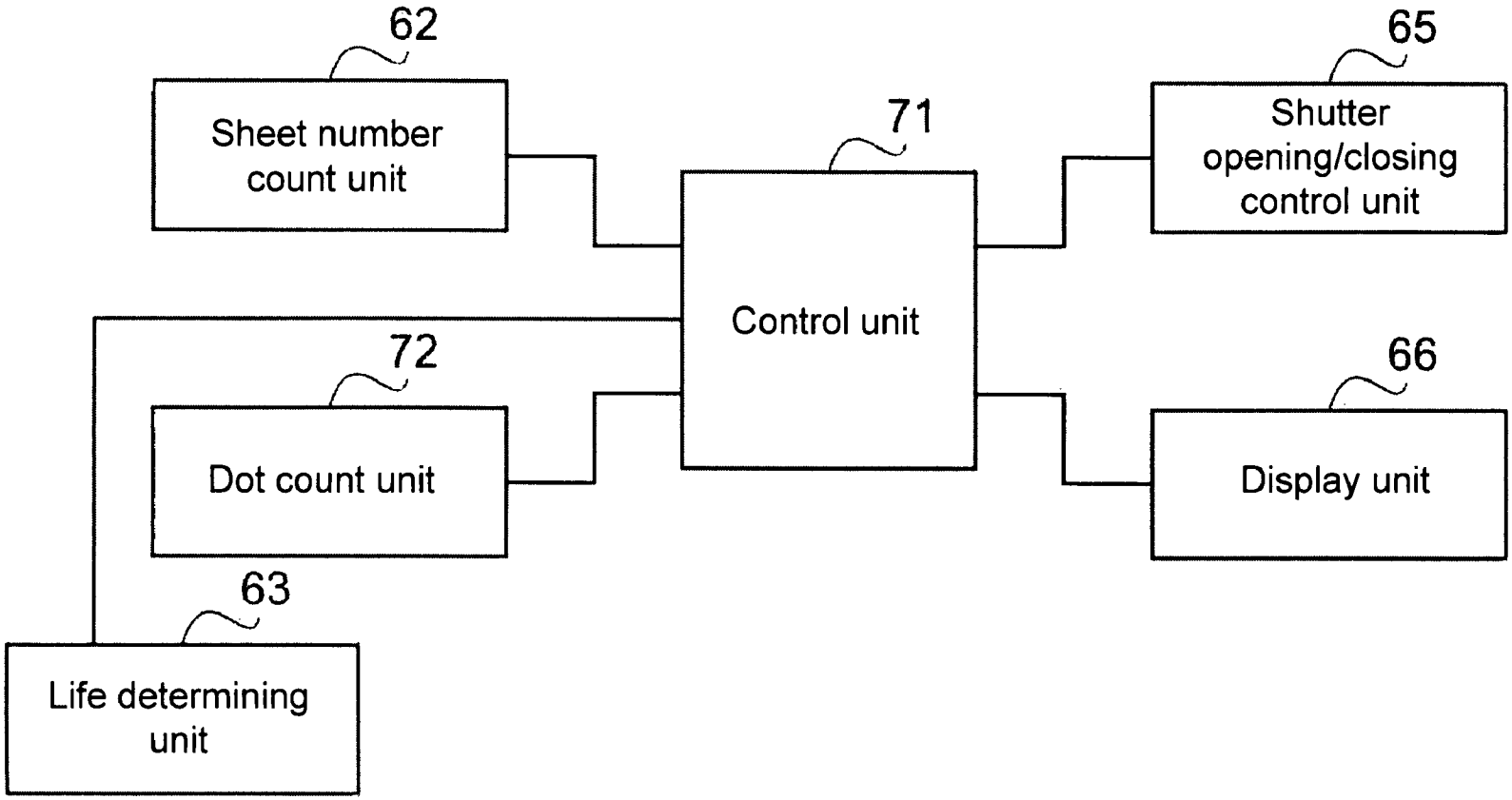
FIG. 6 is a block diagram showing a control system of an image forming apparatus according to a second embodiment of the present invention.

FIG. 6 is a block diagram showing a control system of the image forming apparatus 1 according to the second embodiment of the present invention. As shown in FIG. 6, the image forming apparatus 1 includes a control unit 71 and the dot count unit 72. Other components of the image forming apparatus 1 are similar to those of the image forming apparatus 1 in the first embodiment, and explanations thereof are omitted. Only a configuration of the dot count unit 72 and an operation of replacing the process cartridge 2 and the toner cartridges 44 will be explained.

A control sequence associated with the replacement of the process cartridge 2 and the toner cartridges 44 will be explained next. When the process cartridge 2 is replaced, it is controlled such that toner stops being supplied at an early timing in one of the toner cartridges 44 having a large remaining amount of toner, so that the toner cartridge 44 can be used after the process cartridge 2 is replaced. Further, it is controlled such that toner keeps being supplied until the end in another of the toner cartridges 44 having a small remaining amount of toner, so that the toner cartridge 44 can be discarded after the process cartridge 2 is replaced.

As shown in FIG. 6, the image forming apparatus 1 includes the control unit 71 formed of a CPU, an ROM, an RAM, an input/output port, a timer, and the likes. The control unit 71 controls a series of processes for developing image data on the recording medium 4 according to the image information received from a host device. Further, the control unit 71 is connected to the sheet number count unit 62; the life determining unit 63; the dot count unit 72; the shutter opening/closing control unit 65; and the display unit 66.

In the embodiment, the dot count unit 72 measures the print dot number in each of the image forming portions 31 from when the process cartridge 2 is attached to the image forming apparatus 1 according to the instruction from the control unit 71. The control unit 71 determines a timing when toner starts being supplied from the toner cartridges 44 to the image forming portions 31 according to the remaining amount of toner determined with the dot count unit 72.

Figure 7:
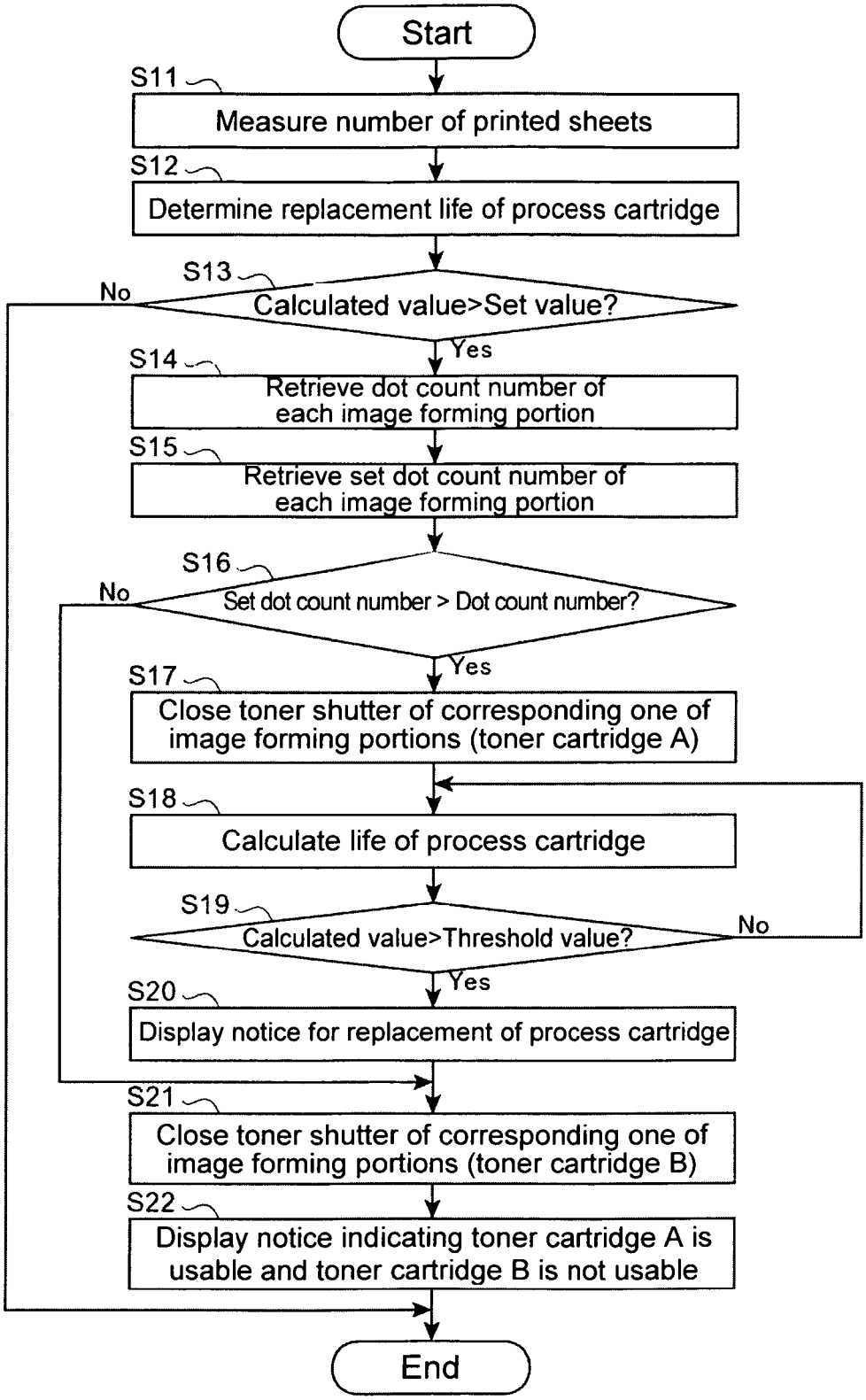
FIG. 7 is a flow chart showing an operation of the image forming apparatus according to the second embodiment of the present invention.

An operation of replacing the process cartridge 2 in the image forming apparatus 1 will be explained next. FIG. 7 is a flow chart showing an operation of the image forming apparatus 1 according to the second embodiment of the present invention. When the process cartridge 2 is replaced, it is controlled such that toner stops being supplied at an early timing in one of the toner cartridges 44 having a large remaining amount of toner, so that the toner cartridge 44 can be used after the process cartridge 2 is replaced. Further, it is controlled such that toner keeps being supplied until the end in another of the toner cartridges 44 having a small remaining amount of toner through the flow chart shown in FIG. 7.

In step S11, when the number of the printed sheets measured with the sheet number count unit 62 according to the instruction from the control unit 71 exceeds a specific number, the replacement display determining sequence starts, so that it is determined whether information regarding the replacement of the process cartridge 2 and the toner cartridges 44 is displayed on the display unit 66 of the image forming apparatus 1. The process from step S12 to step S14 is similar to the process from step S2 to step S4 shown in FIG. 5, and an explanation thereof is omitted.

In step S15, according to the instruction from the control unit 71, a set dot count number for each of the image forming portions 31 is retrieved from when the process cartridge 2 is attached to the image forming apparatus 1. In the embodiment, the set dot count number is determined in advance according to a usage environment of the image forming apparatus 1 and the likes.

A large amount of toner remains in one of the toner cartridges 44 of the image forming portions 31 having a small dot count number. Accordingly, the toner shutter 45 is closed at an early timing to reduce consumption of toner. On the other hand, only a small amount of toner remains in another of the toner cartridges 44 of the image forming portions 31 having a large dot count number. Accordingly, the toner shutter 45 is closed just before the process cartridge 2 is replaced to facilitate consumption of toner.

As described above, in the embodiment, the closing timing of the toner shutter 45 is determined according to the remaining amount of toner in the toner cartridge 44. More specifically, in step S16, the set dot count number obtained in step S15 is compared with the dot count number determined in step S14. When the set dot count number exceeds the dot count number, the process proceeds to step S17. When the set dot count number is less than the dot count number, the process proceeds to step S20.

In step S17, the toner shutter 45 of a corresponding one of the image forming portions 31 is closed according to the instruction from the control unit 71. Note that the toner cartridge 44 of the corresponding one of the image forming portions 31 is referred to as a toner cartridge A. In step S18, according to the instruction from the control unit 71, the life of the process cartridge 2 is calculated from the number of the printed sheets measured with the sheet number count unit 62.

In step S19, a calculated value of the life of the process cartridge 2 calculated in step S18 is compared with a threshold value determined in advance. When the calculated value exceeds the threshold value, the process proceeds to step S20. When the calculated value is less than the threshold value, the process returns to step S18 after a specific period of time. In the embodiment, the threshold value is determined in advance according to the use environment of the image forming apparatus 1 and the likes. In step S20, according to the instruction from the control unit 61, a notice is displayed on the display unit 66 for prompting the replacement of the process cartridge 2. In step S21, the toner shutter 45 of one of the image forming portions 31 determined that the set dot count number is less than the dot count number in step S16 is closed according to the instruction from the control unit 71. Note that the toner cartridge 44 of the one of the image forming portions 31 is referred to as a toner cartridge B. In step S22, the display unit 66 displays a notice indicating that the toner cartridge A is usable and the toner cartridge B is not usable, thereby completing the replacement display determining sequence.

As described above, a large amount of toner remains in one of the toner cartridges 44 of the image forming portions 31 having the small dot count number. Accordingly, the toner shutter 45 is closed at an early timing to reduce consumption of toner. As a result, it is possible to use the toner cartridge 44 one more time after the process cartridge 2 is replaced. On the other hand, only a small amount of toner remains in another of the toner cartridges 44 of the image forming portions 31 having a large dot count number. Accordingly, the toner shutter 45 is closed just before the process cartridge 2 is replaced to facilitate consumption of toner, thereby preventing the toner cartridge 44 from being used one more time. As a result, it is possible to effectively replace the toner cartridges 44 and prevent print defects such as a blurred image due to insufficient toner.

In the embodiments described above, the printer is explained as the image forming apparatus, and the present invention is not limited thereto. The present invention is applicable to a facsimile, a copier, and a multi-function product. Further, the image forming portion 31 includes the image forming portions 31C, 31M, 31Y, and 31K corresponding to colors of cyan, magenta, yellow, and black, and may include the image forming portions 31C, 31M and 31Y without the image forming portion 31K for black. Further, the image forming portion 31 may include two image forming portions 31K both for black.

The disclosure of Japanese Patent Application No. 2008-171422, filed on Jun. 30, 2008, is incorporated in the application by reference.

While the invention has been explained with reference to the specific embodiments of the invention, the explanation is illustrative and the invention is limited only by the appended claims.

What is claimed is:

1. An image forming apparatus, comprising:

an image forming portion for forming an image according to image information;

an image forming unit arranged to be detachable and integrally including the image forming portion;

a developer container arranged to be detachable for supplying developer to the image forming portion;

a blocking member for blocking developer from being supplied from the developer container to the image forming portion; and a control unit for determining a timing to block developer according to a print dot number when a consumed amount of the image forming unit becomes a specific amount so that the control unit controls the blocking member to start blocking developer at the timing.

2. The image forming apparatus according to claim 1, further comprising a life determining unit for determining a life of the image forming unit so that the blocking member blocks the developer from being supplied from the developer container to the image forming portion before the life of the image forming unit.

3. The image forming apparatus according to claim 1, wherein said blocking member is configured to be a separate member to be operable in the image forming portion.

4. The image forming apparatus according to claim 1, further comprising a dot count unit for measuring the print dot number of the image forming portion so that the blocking member blocks the developer from being supplied from the developer container to the image forming portion before the life of the image forming unit when the print dot number is less than a specific level.

5. The image forming apparatus according to claim 1, further comprising a dot count unit for measuring the print dot number of the image forming portion after the developer container is replaced so that the blocking member blocks the developer from being supplied from the developer container to the image forming portion before the life of the image forming unit when the print dot number is less than a specific level.

6. The image forming apparatus according to claim 1, wherein said blocking member includes a portion for engaging an engaging portion formed on the image forming unit when the developer container is detached from the image forming unit.

7. The image forming apparatus according to claim 1, further comprising a developer remaining amount detection unit for detecting the amount of developer in the developer container.

8. The image forming apparatus according to claim 1, wherein said control unit determines the timing to block developer according to a consumed amount of developer when developer in the developer container decreases to the specific amount.

9. The image forming apparatus according to claim 1, wherein said control unit determines the timing to block developer earlier when a consumed amount of developer is small.

10. The image forming apparatus according to claim 1, wherein said image forming unit is integrally disposed at a plurality of positions, said control unit determining the timing to block developer according to a consumed amount of developer when one of the image forming units consumes developer for a specific amount.

11. The image forming apparatus according to claim 1, wherein said image forming unit is integrally disposed at a plurality of positions, said control unit determining the timing to block developer earlier in one of the image forming units when the one of the image forming units consumes a less amount of developer.

12. The image forming apparatus according to claim 1, wherein said image forming unit is integrally disposed at a plurality of positions, said control unit determining the timing to block developer in an order of a consumed amount of developer consumed in the image forming units.

13. An image forming unit, comprising:

an image forming portion for forming an image upon receiving light;

a developer container arranged to be detachable for supplying developer to the image forming portion; and a blocking member for starting to block developer from being supplied from the developer container to the image forming portion at a timing determined according to a print dot number when a consumed amount of the image forming portion becomes a specific amount.

14. The image forming unit according to claim 13, wherein said blocking member is configured to be a separate member to be operable in the image forming portion.

15. The image forming unit according to claim 13, further comprising an urging member for urging the blocking member in a direction that the blocking member blocks the developer, and an engaging portion for opening the blocking member against an urging force of the urging member.

16. The image forming unit according to claim 13, further comprising an urging member for urging the blocking member in a direction that the blocking member blocks the developer, an engaging portion for opening the blocking member against an urging force of the urging member, and an operation bar for engaging the engaging portion to move the engaging portion.

* * * * *